US005647320A

United States Patent [19]

Preuss et al.

[11] Patent Number: 5,647,320

[45] Date of Patent: Jul. 15, 1997

[54] METHOD AND DEVICE FOR ASSEMBLING AN INJECTION PUMP ELEMENT

[75] Inventors: Rolf Preuss, Pulheim; Josef Vonnahme, Cologne, both of Germany

[73] Assignee: Klöckner-Humboldt-Deutz AG, Cologne, Germany

[21] Appl. No.: 489,820

[22] Filed: Jun. 13, 1995

[30] Foreign Application Priority Data

Jun. 16, 1994 [DE] Germany ..... 44 21 087.6

[51] Int. Cl.[6] ..... F02D 31/00

[52] U.S. Cl. ..... 123/372; 123/364

[58] Field of Search ..... 123/372, 364, 123/365, 357, 359

[56] References Cited

U.S. PATENT DOCUMENTS

| | | | |
|---|---|---|---|
| 4,432,320 | 2/1984 | Brasseur | 123/372 |
| 4,448,166 | 5/1984 | Amemori | 123/364 |
| 4,495,914 | 1/1985 | Ishii | 123/372 |
| 4,512,305 | 4/1985 | Pitozzi | 123/372 |
| 4,557,235 | 12/1985 | Amemori | 123/372 |
| 4,677,952 | 7/1987 | Visek | 123/372 |
| 4,850,321 | 7/1989 | Brisbon | 123/364 |

FOREIGN PATENT DOCUMENTS

| | | | |
|---|---|---|---|
| 42 07 702 A1 | 11/1992 | Germany . | |
| 2030321 | 4/1980 | United Kingdom | 123/372 |

*Primary Examiner*—Carl S. Miller

*Attorney, Agent, or Firm*—Charles L. Schwab Hardaway Law Firm, P.A.

[57] ABSTRACT

A method and device for assembling and setting the injection pump elements in which the control rod is pressed against an elastically compliant stop in the form of a pin, which engages one end of a longitudinal groove of the control rod. In this position of the control rod, the injection pump elements have an adjusting pin inserted into a recess of the control rod, which adjusting pin is connected by a control arm to the plunger of the injection pump element, and the injection pump element is rotated so that the control arm lies against a stop of the injection pump element. The injection pump element is then bolted in place in this position.

By this method and device the control rod, during assembly, is intentionally set a short distance further than it is possible to move it in normal operation by the controller.

5 Claims, 2 Drawing Sheets

METHOD AND DEVICE FOR ASSEMBLING AN INJECTION PUMP ELEMENT

TECHNICAL FIELD

This invention relates to a method and a device for assembling an injection pump element of an internal combustion engine. The injection pump element has a plunger with a control arm and adjusting pin for setting the fuel delivery quantity, the adjusting pin being insertable in a recess of a control rod.

BACKGROUND OF THE INVENTION

A method and device for assembling an injection pump element are show and described in German patent document DE-OS 42 07 702. In assembling and setting the injection pump elements, the control rod is pressed against a fixed stop pin, which engages one end of a longitudinal groove of the control rod. In this position of the control rod, the injection pump elements have an adjusting pin inserted into a recess of the control rod, which adjusting pin is connected by a control arm to the plunger of the injection pump element, and the injection pump element is rotated so that the control arm lies against a stop of the injection pump element. The injection pump element is then bolted in place in this position.

OBJECTS AND SUMMARY OF THE INVENTION

It is an object of the invention to provide an improved method and device, for assembling an injection pump element.

The need for an improvement in the assembly method over the prior art is based on the knowledge that in previous assembly of the injection pump elements, it was possible for damage to occur to the adjusting pin and the control arm. It was determined that the damage was caused by the controller, which moves the control rod at a high speed during the control process. The control rod impacts against a rigid control-rod stop arranged in a longitudinal groove of the control rod, this control-rod stop being, however, used at the same time for positioning of the control arm on its stop. If the control arm and thus also the adjusting pin are now rotated by even a small amount relative to the control-rod stop during assembly, in such a way that the control rod, upon the motions caused by the controller, impacts not against the control-rod stop but against the stop of the control arm, then the adjusting pin or the control arm could be damaged by the strong forces acting thereon. This disadvantage is avoided by means of the device and the method of this invention. In the method of this invention the control rod, on assembly of the injection pump elements, is pressed against an elastically compliant control-rod stop and in this assembly position, the control arm, rotated against its own stop, has the adjusting pin inserted and fastened in the recess of the control rod. By this method the control rod, during assembly, is intentionally set a short distance further than is possible in normal operation by the controller. In this assembly position, the individual injection pump elements are then aligned to the control rod. By this method it is insured that in normal operation, when the controller moves the control rod and the control rod rests against the control-rod stop, the control arm of the injection pump element is just short of making contact with its stop. By this arrangement it is insured that the adjusting pin or the control arm can be moved freely under all operating conditions without impacting against a stop. Thus, the danger of possible damage is eliminated. The control rod stop is made so elastically compliant that it is loaded with, for example, a force of 500 newtons during assembly of the injection pump elements and yields by a certain travel distance at this load. In normal operation of the internal combustion engine, the controller moves the control rod with such a maximum speed that a force of, for instance, 300 newtons occurs. This force is accordingly not sufficient to displace the control rod stop by the additional travel distance involved in assembly. In development of the invention, for setting of the basic delivery quantity, the control arm of the injection pump element is rotated against the stop and the adjusting pin is pressed against the assembly motion direction of the control rod. By this method it is insured that in normal operation of the internal combustion engine and of the controller, the control arm cannot impact against its stop. Possible damage is therefore eliminated. The setting of the basic delivery quantity is not affected by this improvement because the control arm can be displaced from the stop by a small adjustment travel up to a setting of the basic delivery quantity without affecting the delivery quantity.

In the preferred embodiment of the invention the elastically compliant control rod stop is a spring. This spring can be made in a wide variety of forms and must in all variations fulfill the requirement that in assembly of the injection pump elements, the control rod is displaceable by a small travel distance further than in the normal controller motion.

The control rod stop can also take the form of a clamping sleeve. A clamping sleeve is especially suitable as an elastically compliant control rod stop because the clamping sleeve is already made as a spring element in its basic design. An additional spring element can be incorporated in the clamping sleeve. The additional spring element is preferably implemented by means of two slots lying one above the other in the clamping sleeve. This spring element then cooperates with the control rod.

The spring travel for the elastically compliant control rod stop may be between 0.1 and 0.6 mm, but preferably 0.3 mm. This travel is sufficient to positively prevent the adjusting pin or the control arm from hitting the stop of the injection pump element during normal operation.

BRIEF DESCRIPTION OF THE DRAWINGS

One embodiment of the invention is illustrated in the drawings, in which.

DETAILED DESCRIPTION OF THE DRAWINGS

Figure 1:
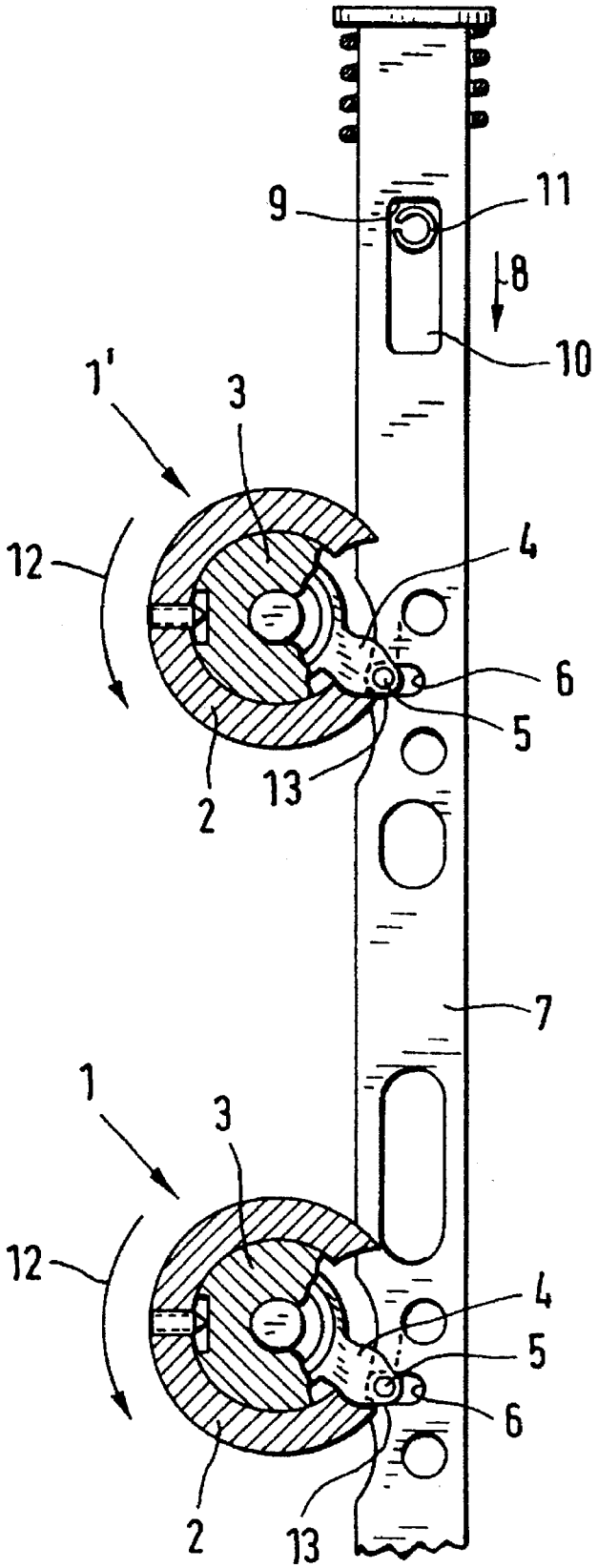
FIG. 1 shows two injection pump elements that cooperate with a control rod.

The injection pump elements 1, 1' shown in FIG. 1 are identical as to their structure and are directly inserted into the crankcase of an autoignition-type internal combustion engine. The invention is not, however, restricted to internal combustion engines or injection pump elements 1, 1' made in this fashion, but can also be used in the case of injection pump elements that are inserted into a separate housing such as, for example, in-line injection pumps.

The injection pump elements 1, 1' each have a cylindrical base 2, in each of which a plunger 3 is movable axially and radially. By means of the axial movement, the fuel is delivered from a low-pressure system into a high-pressure system and the quantity of fuel delivered is established by the radial angular position of the plunger 3 provided with an oblique-edge control. Accordingly, the individual injection pump elements 1, 1' must be set such that they deliver equal delivery quantities given a common radial displacement of the plungers 3. The common radial rotation of the plungers 3 is effected by control arms 4, which are rigidly connected to the plungers 3 and each of which supports an adjusting pin 5 on the end remote to the plunger 3. This adjusting pin 5 in the normal position extends into a recess 6 of a control rod 7 and is guided by the recess 6. If the control rod 7 is displaced in the direction of its longitudinal axis, it thus simultaneously rotates the plungers 3 by equal amounts. In order to set the basic delivery quantity, the control rod 7 is moved in the assembly motion direction 8, for example by an assembly tool, until, with an end stop 9 of a longitudinal recess 10, it makes contact with a clamping sleeve 11 and, by the force applied by the assembly tool, displaces at least a part of the clamping sleeve 11 in elastically compliant fashion in the assembly motion direction 8. In this position, the control rod 7 is blocked and the injection pump elements 1, 1' have their base body 2 rotated in the direction of arrows 12 with the control arm 4 and the adjusting pin 5 held in the recess 6 of the control rod 7. During the in-rotation process, the control arm 4 lies against a stop of the base body 2. After the injection pump elements 1, 1' are set in such fashion, they are bolted in place in this position and then the assembly tool holding the control rod in place is removed. In this way, the control rod 7 moves back by a small travel distance opposite to the assembly motion direction 8 and thus moves the adjusting pins 5 or the control arms 4 by a short distance from the respective stops 13. During the operation of the internal combustion engine, the controller can now move the control rod only until it is against the clamping sleeve 11, without moving said clamping sleeve in elastically compliant fashion.

Further, in a simple method of setting the delivery quantity of the injection pump elements, a constant torque is applied to the individual injection pump elements. This already leads to a high accuracy of adjustment, which is adequate for many applications. The individual injection pump elements 1, 1' can, however, have unequal frictional moments on rotation of the pump elements. If now the adjusting pin is rotated against the side wall of the recess 6, the torque that must be applied becomes greater. While the injection pump element 1' is now further rotated by an amount a until the constant torque is achieved, the injection pump element 1 may have to be further rotated by an amount b until the constant torque is achieved if its frictional moment is smaller.

In an improved setting method, the base bodies 2 of the injection pump elements 1, 1' are again rotated until the adjusting pins 5 are in contact with the side wall of the recess 6 of the control rod 7. The torque that must be applied is then measured. After the contact of the adjusting pin 5 against the side wall, or even during the rotation process, a constant amount is now added to the previously measured torque and this increased torque is applied to rotate the base body 2 further. By this method, a constant additional rotation by a travel distance c results for both injection pump elements 1, 1', and an identical setting of the basic delivery quantity of both injection pump elements 1, 1' is insured.

It should be understood that the invention is not restricted to the setting of the basic delivery quantity of two injection pump elements, but instead an arbitrary number of injection pump elements can be set with the method according to the invention.

Figure 2:
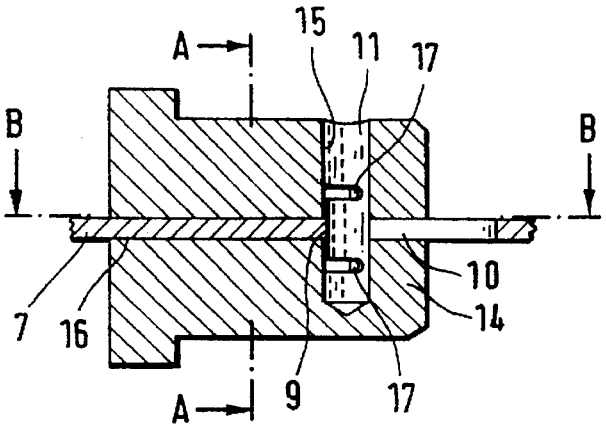
FIG. 2 is a section through a retainer of a clamping sleeve having a control rod in contact.

FIG. 2 shows the clamping sleeve 11, which is inserted into a retainer 14. A hole 15 is made in the retainer 14, into which hole the clamping sleeve 11 can be driven. At a right angle to the hole 15, a hole 16 is made in the retainer 14 to accept the control rod 7. The control rod 7 is inserted into the hole first, so that the longitudinal recess 10 of said control rod cooperates with the hole 15. Afterward, the clamping sleeve 11 is driven into the hole 15. The control rod 7 is now movable until its end stop 9 is in contact with the clamping sleeve 11. In order to assemble the injection pump elements 1, 1', the control rod is then further movable by a short travel distance of preferably 0.3 mm if an increased force is applied. This is achieved by virtue of the fact that the clamping sleeve 11 has slots 17 on either side of the hole 16, which slots form a spring element in the region cooperating with the end stop 9 of the control rod 7.

Figure 3:
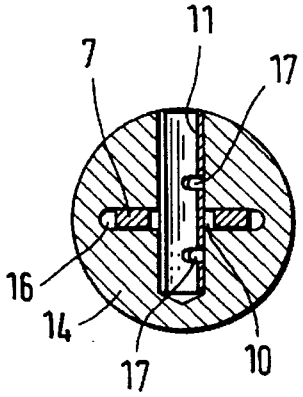
FIG. 3 is a section taken along line A—A in FIG. 2.
Figure 4:
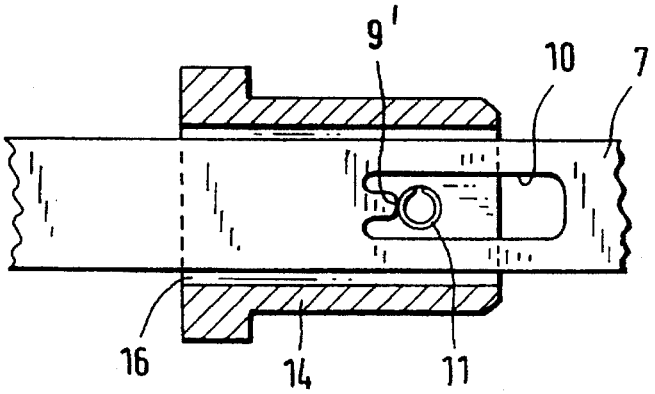
FIG. 4 is a section taken along the line B—B in FIG. 2.

FIGS. 3 and 4 show further details, of the invention. In FIG. 4 an end stop 9' is shown which differs from the end stop 9 shown in FIG. 1.

What is claimed:

1. A method for assembling an injection pump element of an internal combustion engine, of the type including a rotatably shiftable base body and a plunger having a control arm with an adjusting pin for the setting of the fuel delivery quantity, which is insertable in a recess of a control rod when said control rod is shifted longitudinally to a basic fuel delivery position, said method comprising the steps of:

providing an elastically complaint control rod stop (11), assembling said injection pump element (1,1') including pressing said control rod (7) in an assembly motion direction (8) against said elastically compliant control rod stop (11), whereby said elastically complaint control rod stop (11) is elastically deformed and said control rod (7) is shifted longitudinally beyond said basic fuel delivery position, rotating said control arm (4) against a stop (13) on said base body (2), inserting said adjusting pin (5) in said recess (6) of said control rod (7) and securing said base body (2) against rotation.

2. A device for controlling injection pump elements of an internal combustion engine, comprising;

an injection pump plunger (3) having a control arm with an adjusting pin (5) for the setting of the fuel delivery quantity, a control rod (7) having a recess (6), said adjusting pin (5) being inserted in said recess (6) of said control rod (7) and an elastically complaint control rod stop in the form of a clamping sleeve (11), said control rod (7), upon installation of said injection pump elements (1,1'), being displaceable against said clamping sleeve (11).

3. The device according of claim 2 wherein said clamping sleeve (11) includes a spring element.

4. The device of claim 3, wherein said clamping sleeve (11) includes two slots (17) that bound said spring element.

5. The device of claim 2, wherein the spring travel of said clamping sleeve (11) is 0.1 mm to 0.6 mm.

* * * * *